US006673215B2

(12) United States Patent
DeWent

(10) Patent No.: US 6,673,215 B2
(45) Date of Patent: Jan. 6, 2004

(54) ELECTROSTATIC COATING METHOD

(75) Inventor: Charles R. DeWent, El Cajon, CA (US)

(73) Assignee: Action Caps LLC, San Diego, CA (US)

( * ) Notice: Subject to any disclaimer, the term of this patent is extended or adjusted under 35 U.S.C. 154(b) by 37 days.

(21) Appl. No.: 10/230,631

(22) Filed: Aug. 28, 2002

(65) Prior Publication Data

US 2003/0003240 A1 Jan. 2, 2003

Related U.S. Application Data

(60) Division of application No. 09/969,832, filed on Oct. 2, 2001, now Pat. No. 6,464,787, which is a continuation-in-part of application No. 09/522,784, filed on Mar. 10, 2000, now Pat. No. 6,325,899.

(51) Int. Cl.[7] ..... H05E 3/00; B05D 1/04

(52) U.S. Cl. ..... 204/164; 427/471; 427/458

(58) Field of Search ..... 204/164, 297, 204/662, 471; 427/458, 471; 118/638, 500, 504; 422/186.06

(56) References Cited

U.S. PATENT DOCUMENTS

| | | | |
|---|---|---|---|
| 2,553,724 A | 5/1951 | Ransburg | |
| 3,476,082 A | 11/1969 | Cowles | |
| 3,509,036 A | 4/1970 | Igras et al. | |
| 3,575,832 A | 4/1971 | Johnson | |
| 3,777,875 A | 12/1973 | Sobran | |
| 3,785,952 A | 1/1974 | Ritzenhoff | |
| 4,069,790 A | 1/1978 | Witte | |
| 4,088,559 A | 5/1978 | Sandmeier | |
| 4,097,359 A | 6/1978 | Davitz | |
| 4,099,486 A | 7/1978 | Bialorucki | |
| 4,217,853 A | 8/1980 | Davitz | |
| 4,421,627 A | 12/1983 | LeBaron | |
| 4,628,859 A | 12/1986 | Hines | |
| 4,668,358 A | 5/1987 | Ball | |
| 4,682,562 A | 7/1987 | Hell | |
| 4,988,426 A | 1/1991 | Metzka | |
| 5,119,140 A | 6/1992 | Berkes | |
| 5,133,161 A | 7/1992 | Reas | |
| 5,524,774 A | 6/1996 | Cullen | |
| 5,551,552 A | 9/1996 | Ophardt | |
| 5,617,800 A | 4/1997 | Moreschi | |
| 5,753,042 A | 5/1998 | Bauer | |
| 5,897,709 A | 4/1999 | Torefors | |
| 5,908,120 A | 6/1999 | Yates | |
| 5,930,471 A | 7/1999 | Milewski | |
| 5,936,536 A | 8/1999 | Morris | |
| 6,036,779 A | 3/2000 | Tolbert | |
| 6,040,037 A | 3/2000 | Imai | |
| 6,325,899 B1 * | 12/2001 | DeWent | 204/164 |

FOREIGN PATENT DOCUMENTS

| | | |
|---|---|---|
| DE | 3631747 A1 | 3/1988 |
| DE | 9106199.7 | 7/1991 |
| DE | 29507807 U1 | 9/1995 |
| EP | 56062565 | 5/1981 |
| EP | 04190864 | 7/1992 |
| EP | 0933140 A1 | 8/1999 |
| GB | 909915 | 11/1962 |
| JP | 57078964 | 5/1982 |
| JP | 2004475 | 1/1990 |
| WO | US/01/03016 | 1/2001 |

* cited by examiner

*Primary Examiner*—James J. Seidleck
*Assistant Examiner*—Thao Tran
(74) *Attorney, Agent, or Firm*—Brown, Martin, Haller & McClain LLP

(57) ABSTRACT

The invention relates to an intermediate component for protecting hangers associated with electrostatic coating processes. The component is an electrically conductive, pliable, tubular member, and inexpensive relative to the hanger which it serves to protect. The component lessens the cost associated with traditional hanger cleaning and preserves hanger life and integrity. The tubular member may have a longitudinal slit for installing the member over a cross bar of a hanger.

10 Claims, 6 Drawing Sheets

ELECTROSTATIC COATING METHOD

CROSS REFERENCE TO RELATED APPLICATIONS

This application is a divisional of application Ser. No. 09/969,832 filed Oct. 2, 2001 now U.S. Pat. No. 6,464,787, which is a Continuation-in-Part of application Ser. No. 09/522,784 filed Mar. 10, 2000 (now U.S. Pat. No. 6,325,899).

BACKGROUND OF THE INVENTION

Electrostatic coating processes rely on a charge differential between an article to be coated and what is used to coat that article. In such processes, the article is typically grounded whereas the coating to be applied is endowed with a charge. When the article and coating are then brought into contact with one another, the result is that the coating adheres to the article. It is estimated that more than 10,000 facilities for accomplishing this exist in the US alone.

Most such coating procedures and facilities employ a variety of steps, i.e., a cleaning step, a drying step, a coating step, and a heating step wherein the adhered coating is cured to afford a more desirable and permanent coat. These steps usually take place sequentially using batch operations commonly employed in the art, or else in specialized stations connected by a continuous conveyor line.

Conveyor lines can be of varying length depending on the facility. Articles to be coated are hung from these lines via spaced electroconductive racks or hangers that serve to ground articles attached thereto. Racks and hangers are popular that have the capacity to hang multiple articles. This is accomplished by multiple hooks, usually spot welded at set distances from one another on the same rack. Such rack and hook configurations vary widely in shape, size, and configuration to support different types and sizes of articles.

Once attached, the hangers or racks bearing grounded articles are conveyed through a coating station followed by a curing station. Once coating and curing are finished, the coated objects are removed and the process begins anew.

The hangers and racks of such systems, being expensive, are typically re-used. After passing through the painting station a number of times, that portion or portions of the hanger which contact the article gradually becomes fouled by coating. The net effect is interference with grounding capacity, with consequent poor transfer efficiency and an eventual possibility for spark or fire. This necessitates periodic replacing or cleaning, which is both time-consuming and expensive.

In the case of recycling, conventional cleaning methods include chemical stripping, molten bath stripping, burning, and mechanical stripping, i.e., sandblasting, hammering, and filing. These processes reduce the useful life and capacity of racks by compromising their structural integrity over time. For example, it is the Applicants' experience that hooks break off fairly regularly, thereby lessening the capacity and desirability of continuing with that rack.

The art has thus far failed to provide a cost-effective alternative.

SUMMARY OF THE INVENTION

The invention provides a surprisingly efficient solution to the long-felt need described above.

It is an object of the invention to provide an electrically conductive intermediate at an interface or contact point between the hanger and article to be coated. This intermediate may be conveniently replaced or recycled at a comparatively small cost relative to existing procedures and implements.

In a first aspect, the invention features a system for extending the operating life of hangers or racks associated with electrostatic coating. This is accomplished by use of a relatively cheap, electrically conductive, and preferably pliable, intermediate that is suitable for grounding an article to be coated. The intermediate is interposed at a contact junction of the article and electroconductive hanger.

In exemplary embodiments, the intermediate slideably engages, wraps, or clamps to the hanger and may even adapt in shape or be engineered to accommodate the particular shape of a hook. In most preferred embodiments the article, via an orifice or recess, envelops at least a portion of the hook and intermediate attached thereto.

Various embodiments contemplate different conductive materials and configurations, including shape, of the intermediate. By way of materials, rubber, plastic, tape, and metalic foils all exist that are conductive and suitable, depending on the precise application. The intermediate may be a silicone sleeve or cap having a hollow interior for receiving a hook portion of a hanger. The article to be coated then fits over or engages this enveloped portion of the hook, usually via an orifice of sufficient dimension.

Concentric "layers" of pliable sleeves are also envisioned for some coating applications wherein one sleeve is positioned over another for rapid exposure of fresh contact surfaces as appropriate. A spent layer is simply peeled away or cut off thereby exposing a fresh one. One such embodiment contemplates a tape. Other embodiments contemplate a plurality of hollow tubes, one over the top of the next. These may be slit lengthwise and deposited one over the top of the next, or else constructed in multiplied layers which are then curled and fixed in form to wrap or clamp to a hanger of interest. Of course, the diameter differential associated with this technique must accordingly be accommodated by the article.

In other embodiments, at least a portion of the hanger itself comprises a nonmetallic material such as a conductive silicone rubber or plastic. This new material can be conductively and integrally fixed during manufacture, e.g., by injection molding. Preferably, the material is pliable or bendable with the hands or other gentle means to quickly release or free unwanted deposits of coating that hinder contact and hence grounding ability. In such embodiments, the sleeve or intermediate is recyclable.

In still other embodiments, the sleeve intermediate is disposable. Of course, everything including hangers are disposable at a cost, but what distinguishes the present invention is the relatively low cost of the intermediate relative to the cost of replacing or recycling a hanger or rack. In embodiments where the intermediate is integrally a part of the hanger, the novelty resides in the hanger being easily cleaned relative to conventional hangers, e.g., metal ones, and more durable or receptive to cleanings.

In exemplary embodiments, the intermediate bridges a hanger and an article to be coated. This bridge may occur in a variety of configurations as one of skill will appreciate. It may occur as described above, or else it may occur by a more comprehensive envelopment, not only of the hanger but also of the entire juncture, including a portion of the article itself. U.S. Pat. No. 5,897,709 issued to Torefors describes one such example. However, instead of a conductive bridge, Torefors specifies a non-conductive ("dielectric") cover. The present invention, by contrast, serves a dual function in further providing a conductive bridge to facilitate grounding and suitable coating, while simultaneously preserving the operative part of the hanger or hook for future use.

In another exemplary embodiment of the invention, an intermediate member is designed for fitting over a horizontal cross-bar type of workpiece hanger which suspends large size panels or the like for electrostatic coating, and comprises a longitudinal, hollow sleeve of pliable, electrically conductive material having a longitudinal slit extending along its length so that the sleeve can be engaged transversely over a cross bar extending between two vertical hangers via the slit. An article to be coated, such as a large flat panel, can then be suspended from the cross bar via conductive hooks which engage over the sleeve.

The elongate sleeve may be of any suitable cross-sectional shape, such as circular, square, rectangular, or octagonal. The slit may form a longitudinal gap or slot in the sleeve, or may be a simple linear cut along the length of the sleeve. Alternatively, the sleeve may have opposite longitudinal edges which are overlapped along the length of the sleeve, so that there is no opening in the sleeve after it has been engaged over the cross bar. In another alternative, the sleeve may have no slit, for engagement over hook like hanger.

In an alternative embodiment, the intermediate may be a sheet or strip of pliable, electrically conductive material which is secured on top of a hanger by an electrically conductive adhesive, such that an article to be coated engages the strip or layer. The pliable strip may have any suitable cross-sectional and peripheral shape, such as square, rectangular, circular, triangular, and the like, and may be solid or may have a through bore. The adhesive may cover all or only part of an inner face of the strip.

The intermediate may suitably be made of a conductive material, preferably rubber, plastic, tape, foil, or grease that can be conveniently removed, disposed of, replaced, or recycled. The intermediate may have resistance of less than 6 megaohms, or one or less megaohms, or 0.5 megaohms, and in one example has a resistance of about 0.1 megaohms or less.

In exemplary embodiments, such intermediates are also heat resistant to temperatures up to 600° F., and may be heat resistant in ranges of between about 250° F. and 450° F.

At present, the favorite known material for the intermediate is conductive silicone, which may be fashioned by mixing different conductive and nonconductive commercially available grades in certain proportions testable by one of skill in the art, using routine experimentation to arrive at a final suitable product. Alternatively, fully conductive commercially available conductive silicone alone can be used that, while more expensive, still represents an improvement in the art.

The material used, e.g., silicone, may be molded to fit the myriad different sizes and shapes of hooks available, or else a universal piece may be used that fits a variety of hook shapes and sizes by conforming pliably in shape. Preferably, these sleeves or caps pull on and off conveniently with minor effort, but are not too loose as to permit undue amounts of coating to seep inside. Looseness is not known to otherwise disadvantage the system, provided there is some contact through which a ground may be established.

A second aspect of the invention features methods for electrostatic coating that make use of the above embodiments, either singularly or, where appropriate, combined. One method of providing an electrostatic pliable coating layer on one or more hanger members comprises dipping at least part of at least one hanger member in a bath of liquid electroconductive material, such as conductive silicone, so that the dipped surface is coated with a layer of electroconductive material, and then lifting the hanger member out of the bath and allowing the coating layer to cure in order to form a pliable, electroconductive coating layer. Some or all of the hanger member may be dipped, and entire hanger racks for use in electrostatically coating many parts at once may be dipped and coated with the pliable electroconductive intermediate.

BRIEF DESCRIPTION OF THE DRAWINGS

The present invention will be better understood from the following detailed description of some exemplary embodiments of the invention, taken in conjunction with the accompanying drawings, in which like reference numerals refer to like parts, and in which:

FIG. 32 illustrates the end cap of FIG. 31 in use during an electrostatic coating process for an automobile hood or the like;

DESCRIPTION OF THE PREFERRED EMBODIMENT

Figure 1:
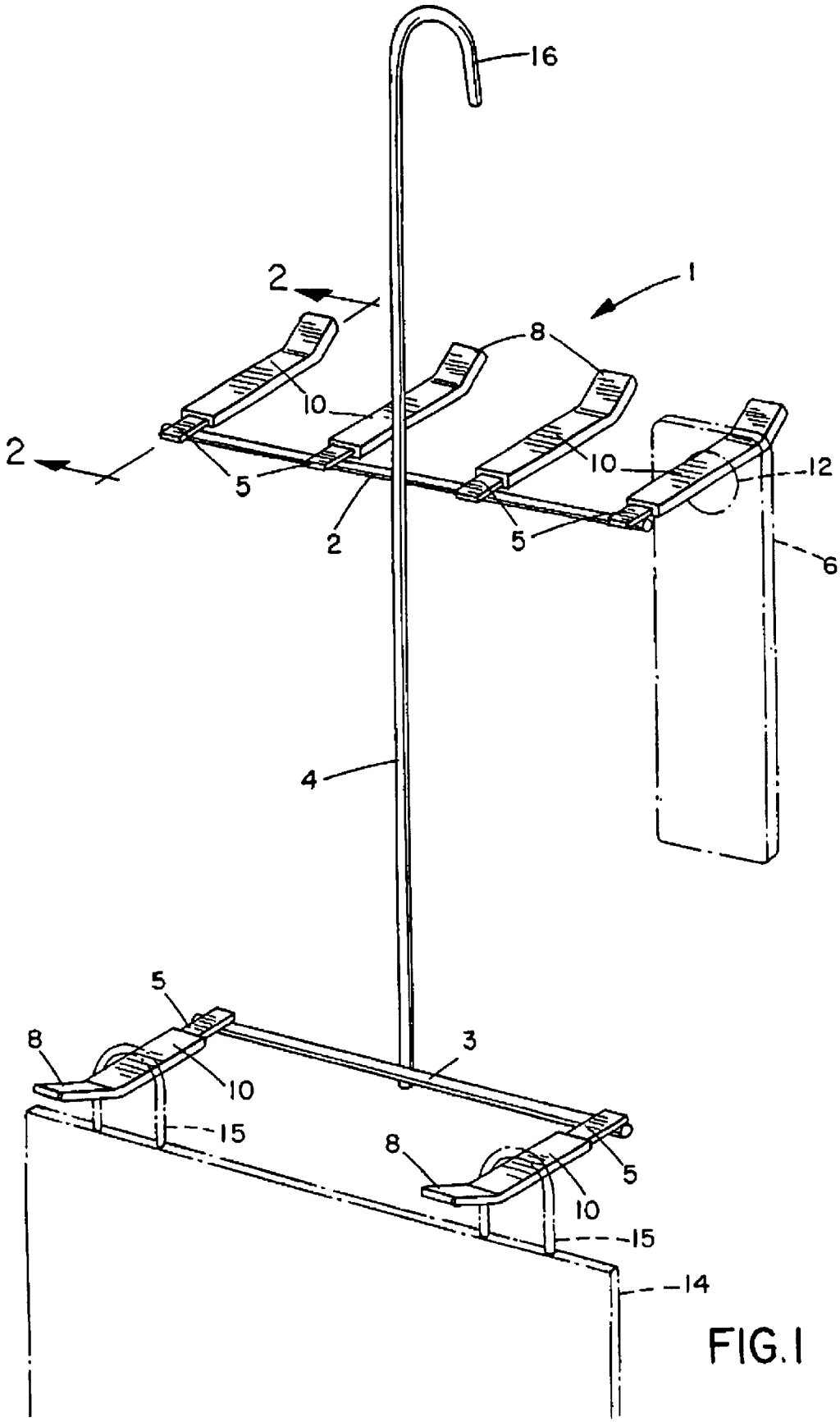
FIG. 1 is a perspective view of a rack with conductive sleeves according to a first embodiment of the invention.

The invention makes use of novel intermediate components for use in electrostatic coating processes. The intermediate is conductive and relatively inexpensive in cost and practice, allowing for ready cleaning and/or replacement with a concomitant more efficient operation afforded to the overall system. The object is the preservation of proper grounding and the protection and preservation of more expensive implements used in the process, e.g., hangers, hooks, and racks.

As used herein, and in the claims, the following terms have the following meanings:

A "system" includes, but is not limited to, traditional apparatuses used in electrostatic coating processes.

The term "electrostatic coating" embraces any powder, paint, or electroplating procedure wherein a charge differential is established to facilitate coating of an object to be coated. This includes but is not limited to the use of thermoplastics and teflon-type additions. Those of skill in the art know the broad latitude of the term, which can apply to different charging techniques and systems.

By "intermediate" refers to an object which interfaces in some fashion with both an article to be coated and an electrically conductive hanger. The shape is not to be construed as limited by the drawings or discussion herein, so long as one or more objects of the invention are otherwise met. The intermediate is typically hollow or capable of being made so, e.g., in the case of foil by wrapping it around a hook to be used in an electrostatic coating process of the invention. In tubular embodiments, this can be a uniform, hollow piece of varying internal and external dimensions, additionally including in some embodiments one or more flanges or grips that allow easy placement and replacement, in addition to providing leverage or mechanical manipulation and recycling. The intermediate can be a sleeve or cap, with the difference being that a sleeve has opposing free ends while a cap does not.

The terms "suitable for grounding", "grounding" and "conductive" are to be understood jointly. "Conductive" means capable of passing a charge, e.g., a stream of electrons, and can mean any substance having suitable resistance and capable of fulfilling one or more objectives of the invention. Preferably, the material should have between about 0 and 6 megaohms of resistance, more preferably less than 1 megaohm of resistance, still more preferably less than 0.5 megaohm of resistance, and most preferably having about 0.1 megaohm or lower resistance. The more preferred parameters respect, although are not limited by, National Fire Protection Agency (NFPA) standards and rationale: "To minimize the possibility of ignition by static electric sparks, powder transportation, application, recovery equipment, work pieces and all other conductive objects shall be grounded with a resistance . . . not exceeding one megaohm." NFPA Bulletin No. 33, Ch. 13, paragraph 13-4c.

"Ground" or "grounding" is a phenomenon that describes an equilibration of charge approximating that of the earth's surface. It is a reference standard by which more or less charge is gauged. For purposes of the invention, however, ground can also embrace situations where the hanger possesses a charge opposite to that of the coating material such that electrostatic bonding is achieved and promotes good transferability and coating.

The term "hanger" is not meant to be geometrically or materially limiting and may embrace a variety of structures and compositions known in the art, including but not limited to conventional metal hangers, racks, hooks, combinations of racks and hooks, and any other instrument useful in securing or supporting an article to be electrostatically coated. Of course, the piece must also be electroconductive and otherwise suitable for electrostatic coating processes. Magnetic systems and applications are also envisioned.

The terms "slideably engages", "wraps", and "clamps" are each broad terms descriptive of many potential, not necessarily mutually exclusive embodiments. Besides what are shown in the instant drawings, another non-limiting example of a clamp, for instance, includes that disclosed in U.S. Pat. No. 5,897,709, herein incorporated by reference. Although the clamp described there is nonconductive, the geometry and other functions can be recruited for purposes of the instant invention.

The terms "silicone", "plastic", "tape", and "foil" similarly have many acceptable permutations that are envisioned to be suitable for the invention, and which are either known in the art, or can be readily determined and implemented without undue experimentation by one of ordinary skill. These are discussed in greater detail below.

The term "integral with said hanger during manufacture" denotes either the conjoining of multiple individual components during manufacture of the hanger itself, or else embodiments where the hanger itself is made entirely of a homogeneous material, e.g., conductive silicone, which presents durability and cleaning advantages over previous compositions, systems, and methods.

The terms "disposable" and "recyclable" are meant to demonstrate alternative, not necessarily mutually exclusive, embodiments. Thus, at the discretion of the end-user a disposed of intermediate may also be suitably recycled. In other embodiments, there can be mutual exclusivity, e.g., where the sleeve, cap, etc., is engineered to fulfill its grounding and protective function only once, and then degrades, e.g., during the heating/curing step.

Other Features of the Intermediates

The conductive intermediates of the invention preferably withstand a temperature in the range of temperatures 200° F. to 600° F., most preferably 450° F., and over course of time about ten (10) or more minutes. Conforming intermediates are preferably pliable adapt in shape to envelop at least that portion of the hanger or rack to which the article to be coated is fastened or hangs. The point of this contact may represent substantially the whole of the exterior surface area of the intermediate, or else may represent any subfraction or portion thereof.

The intermediate may assume the shape of a prophylactic cap or sleeve, e.g., tubular or hollow, that has one or more exposed hanger or rack portions flanking its point of engagement with the hanger. Also, the shape of the intermediate may appear much different in appearance when affixed to the hanger relative to when not affixed. This owes to the intermediate's pliability and/or ready ability to conform in shape to the shape of the hook or subportion thereof to which the intermediate attaches. However, as noted, in certain embodiments the fit can be engineered to be more or less precise, so that pliability is not as great a consideration.

A further aspect is that the intermediate may be readily engaged and detached with minimal effort, e.g., peeled, unwrapped, scraped, or slideably disengaged as needed, and conveniently replaced or recycled so as to economically promote proper grounding and coating efficiency. This is, at least in part, because the cost of the intermediate is typically a fraction of the cost of the other system hardware, e.g., the racks, hooks, and hangers.

The ease with which recycling (where appropriate) is accomplished depends on the physical characteristics of the intermediate. In most preferred embodiments, the intermediate is a conductive silicone having suitable thermal stability. The intermediate is ideally elastomeric or pliable, easily engageable with the hanger, e.g., by sliding over, wrapping, or impaling a surface thereof, and readily disengageable as well.

A further embodiment, as mentioned, is the layered intermediates, wherein a plurality of intermediates overlaying one another are positioned on the rack and peeled off as needed to expose fresh contact area for new objects to be coated or recoated. This layered effect may result either from tape or from layers deposited one atop another. In tubular formats, multiple tubes may be stretched substantially over one another while the bottom most tube directly contacts the hanger/hook/rack and the subsequent added layers indirectly contact it via electrical conductance across the layers. Assumed is that the means for attachment of the article to the intermediate can accommodate a range of thicknesses supplied by the additional layers, and that sufficient contact and hence conductance between the layers can be maintained.

Characteristic of preferred recycling embodiments is that by using minimal or mild perturbation the intermediate can be easily regenerated, i.e., freed of unwanted coating deposits. This is especially so for silicone sleeve embodiments, but not advised for metalic foil embodiments. In the latter case, disposal, or recycling by burning or chemical stripping is preferred. Recycling and nonrecyling embodiments, as stated, are not necessarily mutually exclusive and may be at the discretion of the operator using the system. Such intermediate may therefore be suitable for either process.

It is also anticipated that the inherent benefits of the invention will find additional merit in automation. This will be more or less practicable depending on the specific embodiment used. At present, conductive silicone sleeves or caps are envisioned to best perform the task. They are easily mounted via sliding, clamping, or adhering, and similarly disengageable.

In summary, prior to the invention racks and hangers in the art required frequent replacement or cleaning which entailed considerable cost and labor. Down-time associated with these processes was unacceptable and/or, in the case of recycling, exacted a heavy toll on one or more of the following factors: structure and usable life of the racks and hangers, labor allocation, environmental impact, and energy consumption. With the teachings of the invention, these concerns are overcome, simplifying the overall coating and manufacturing process. The net result is increased efficiency and profit, which may in turn be passed on to the consumer.

EXAMPLE 1

Determining Suitable Ground and Resistance

A common device used to measure continuity to ground, and which may be used to further optimize parameters and configurations suitable for the invention, is an ohm meter having a megaohm scale. This can be a volt/ohm meter (VOM) or a Megger. A VOM is adequate for checking electrical circuits, but its low voltage power source makes it less suited for checking the proper grounding of a coating system. The best device is the Megger which has a power source of 500 volts or higher. This higher voltage provides the current required to accurately measure the resistance to ground.

An exemplary technique for measuring resistance is to start at the end of the process and work backward. The meter is connected between a known building ground and the uncoated part to be tested using a long test lead. This procedure is used to determine that the part is correctly ground through the entire spray booth. The amount of resistance to ground can be read on the meter, as one of skill aware.

Because the meter is attached to a known ground and to a clean part on the conveyor in the booth, all the devices in between (hanger, conveyor, swivels, etc.) are in the circuit and the resistance to proper ground can be measured. If the reading is less than one megaohm, the grounding is ideal.

If the resistance reading is greater than one megaohm, one can verify by hooking the lead to the contact point on the hanger and read it again. Then, by repeating the procedure and working back through the system (swivel or conveyor hook, conveyor) until the resistance reads in the proper range. By this method it can be determined which device needs corrective action.

A similar technique can be used to check for proper grounding of other objects and equipment in the coating area and system.

EXAMPLE 2

Silicone Sleeve or Cap

Figure 2:
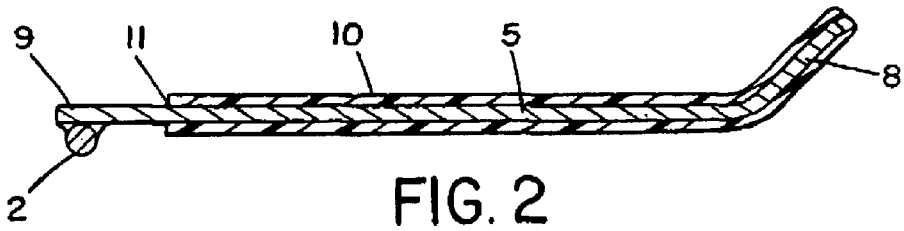
FIG. 2 is an enlarged sectional view taken on line 2—2 of FIG. 1.
Figure 3:
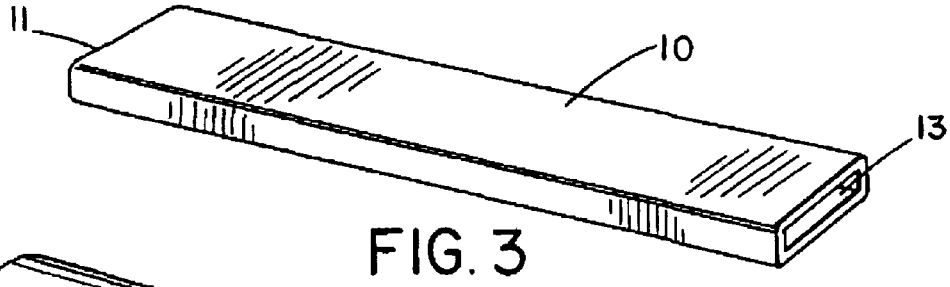
FIG. 3 is a perspective view of a sleeve with rectangular configuration, according to another embodiment of the invention.
Figure 4:
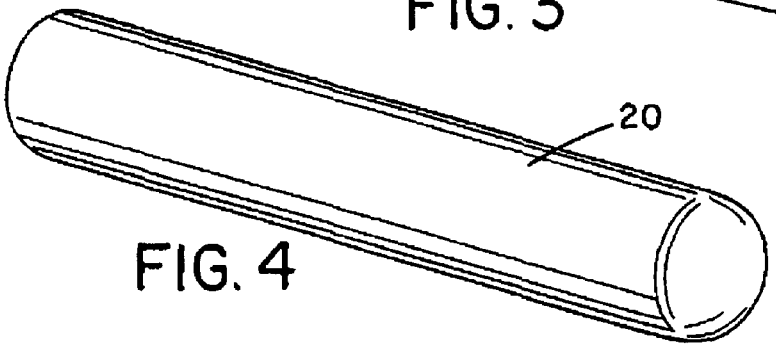
FIG. 4 is a perspective view of an alternative, cylindrical sleeve.
Figure 6:
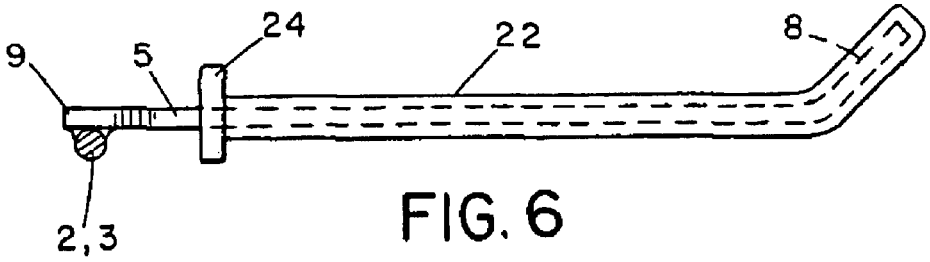
FIG. 6 is a side view of the flanged sleeve mounted on a hook.

A prototype intermediate was designed and built as follows: Three quarter parts conductive silicone rubber compound (Shin-Etsu Chemical Co., Japan; part KE3611U) combined with one quarter part nonconductive silicone paste (Shin-Etsu; part KE961U) was mixed, compression molded, and cured in the form of tubing having a wall thickness of about 0.1 cm and an overall tubing diameter of about 1 cm. With reference to FIG. 2 or 6, the resulting tubing was then cut to approximately 5 cm in length and the resulting sleeve intermediate 1 slideably coaxed over and along the shaft of a metal conductive hook 2 via a free end 3 of said sleeve intermediate 1. This was done until the sleeve 1 substantially covered the hook 2, or at least that portion fated to engage and contact a workpiece or article to be coated.

The overall concept, e.g., for a multi-hooked rack, is illustrated in FIG. 1, which depicts one configuration of sleeve mounted onto a plurality of hooks of a single rack. Each work-piece hook in FIG. 1 is analogized to the individual configurations demonstrated in FIGS. 2 and 6. With reference to FIG. 1, the article or articles to be coated 4 engage the hooks 1 by virtue of one or more orifices or recesses 6 in said article(s) 4 having suitable dimensions for receiving the intermediate sleeve/hook combination 7. At the vertically highest point in the figure is another hook 8 to which the overall rack of the Figure is typically grounded. The hanger diameter for this prototype measured approximately 0.6 cm, although the particular dimensions are not limiting and merely illustrative of one workable embodiment. For this particular prototype, the depth of curve of said portion of the hanger measured 6 cm, and the vertical length of the hanger, not including curve, measured about 55 cm. Analogy may be had with reference to FIG. 1 for other rack and hook configurations.

Coating and curing then proceed as standard in the art. Upon coating, the coated article is removed, an uncoated article added, and the process repeated. Between coatings, typically every 3–5 rounds, the sleeve/fitting is examined for paint build-up and manipulated gently to peel away or relieve unwanted coating build-up on the intermediate, thereby re-establishing a suitable ground for the electrostatic process. If desired, the recycling can take place in situ, or else can first entail removal of the rack or hanger from the conveyor. The latter is preferred so that new racks can be added as the intermediates on the old racks are serviced, thereby promoting a more continuous operation. "Used" sleeves may be replaced with unused ones, followed by a resumption of coating operations, or else the individual sleeves can be removed, gently manipulated to recycle them, and replaced.

For purposes of the prototype, the Applicants formulated the 75:25 mix to decrease costs. Higher ratios of conductive silicone, e.g., 76–100% will also work and still be more economical than previously described art methods, and the Applicants further believe that lower ratios can also be determined without undue experimentation, and using routine procedures.

As one of skill in the art is aware, however, conductive silicones exist that vary in constituents. This may have a bearing on the relative success of the precise functional ratios used. Moreover, as one of skill is also aware, there can be lot-to-lot variations in silicone performance. However, as stated, one of skill may easily determine suitability using minimal, routine experimentation. Indications of some of the variations that exist and methods for preparation of the same may be found, e.g., in U.S. Pat. Nos. 6,010,646, 6,013,201, 5,217,651, 5,164,443, 5,135,980, 5,082,596, 4,957,839, 4,89,8,689, 4,672,016, 4,571,371, 4,552,688, pertinent disclosures of which are herein incorporated by reference.

Besides Shin-Etsu, other current commercial vendors of conductive and nonconductive silicones include Dow Corning (Indianapolis, Ind.) and Toshiba (JP). No doubt other vendors also exist and improvements in silicone structures and characteristics are anticipated.

EXAMPLE 3

Flanged Prototype

Figure 5:
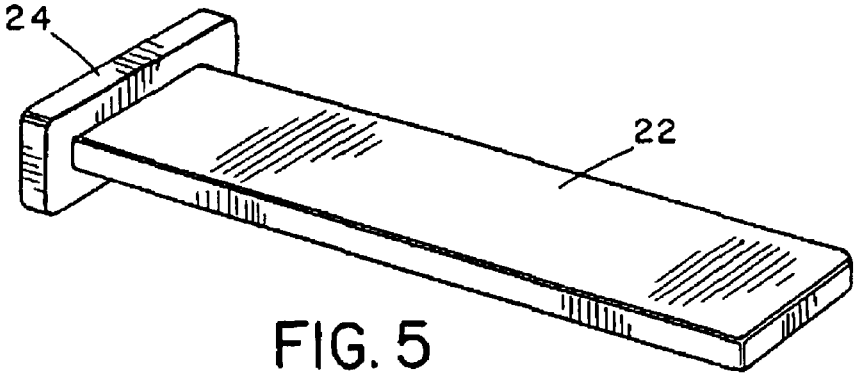
FIG. 5 is a perspective view of a sleeve with a flange for ease of fastening and removal from a hook.

Electrostatic coating is performed as per Example 2, except that instead of a uniformly dimensioned sleeve or cap, the sleeve or cap possesses a flange or rib for gripping or otherwise facilitating the process. This is demonstrated by the prototype exhibited in FIG. 5. The dimensions shown (mm) are designed to fit over a wire hook 2.35 mm in diameter. The internal diameter of the tubing is 2.75 mm, the length is 75.00 mm, the diameter of the flange is 13.00 mm, the flange thickness 1.6 mm, and the tube wall thickness 0.8 mm. This particular embodiment demonstrates a cap format wherein a flange exists on an end opposing the capped (closed) end. When positioned onto the wire hook, this flanged cap or sleeve resembles the format shown in FIG. 6.

EXAMPLE 4

Foil Intermediates

Electrostatic coating is performed as per Example 2, except that instead of using the silicone sleeve fitting, conductive metalic foil, e.g., tin or aluminum, is substituted and wrapped around the bare or otherwise conductive hook to provide an equivalent effect.

EXAMPLE 5

Hybrid Hanger Comprising Conductive Silicone

In this embodiment, hangers are produced via compression molding that are comprised, at least in part, of conductive rubber, e.g., silicone, as described above. The silicone portion, if a minority, is preferably localized to that portion of the hanger as described for Examples 2 and 3. Thus, sleeve fittings as described above are either eliminated or else rendered redundant to the process, with the latter embodiment also anticipated to have independent advantage.

Figure 7:
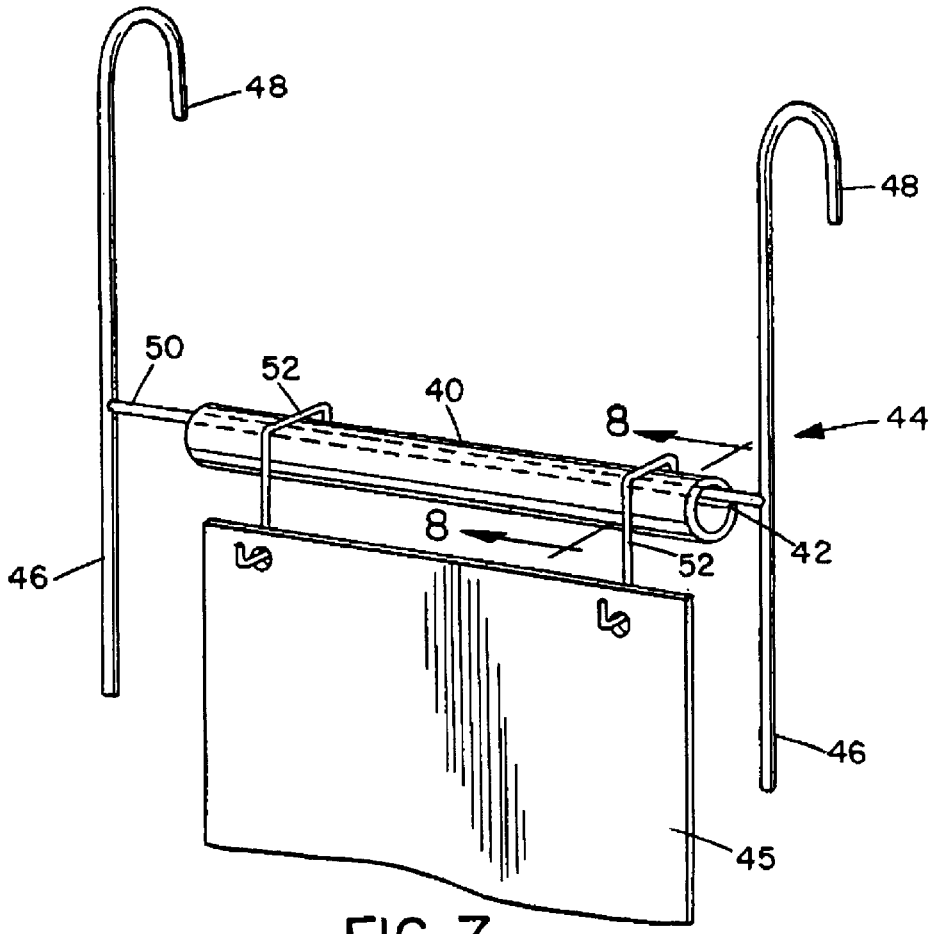
FIG. 7 is a perspective view of a different type of hanger rack and an attached conductive sleeve according to another embodiment of the invention.
Figure 8:
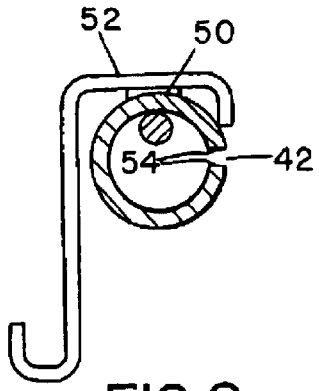
FIG. 8 is a cross-section on the lines 8—8 of FIG. 7.

FIGS. 7 and 8 illustrate an intermediate sleeve 40 of electrically conductive, pliable material according to another embodiment of the invention. The sleeve 40 is an elongate, cylindrical, tubular member which is open at both ends and which has a longitudinal slit 42 extending between its opposite ends. It is designed for fitting over a different type of rack 44 for suspending workpieces such as large, flat panels 45 to be electrostatically coated, as illustrated in FIG. 7. The rack 44 has a pair of vertical posts 46 having grounding hooks 48 for attachment to a conveyor or grounding system, and a cross bar 50 extending between the posts and from which the workpiece 45 is suspended via conductive hooks 52. The elongate conductive sleeve 40 can be fitted over the cross bar 50 via the slit 42, as indicated in FIGS. 6 and 7. In this example, the slit 42 is defined between opposite longitudinal side edges 54 which are spaced apart to form a gap.

Figure 9:
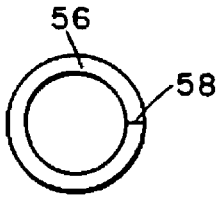
FIG. 9 is a section similar to FIG. 8 illustrating a modified sleeve for use with the rack of FIG. 7.
Figure 10:
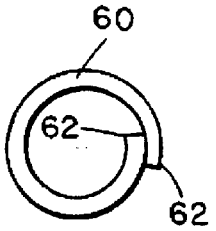
FIG. 10 illustrates another modified sleeve.
Figure 11:
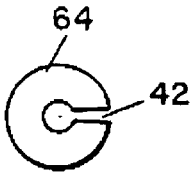
FIG. 11 is a section similar to FIGS. 8 to 10 illustrating another modified sleeve.

FIG. 9 illustrates a modified cylindrical sleeve 56 in which a simple longitudinal slit 58 is cut, with no gap between opposing side edges of the cut. FIG. 10 illustrates another alternative sleeve configuration 60 in which opposite longitudinal side edges 62 of the sleeve are overlapped. Due to the pliable nature of the sleeve material, opposite side edges of the sleeve can be urged apart in both of the embodiments of FIGS. 9 and 10 while the sleeve is inserted transversely over cross bar 50, and then released to close the slit as in FIGS. 9 and 10, for added security. FIG. 11 illustrates a modified cylindrical sleeve 64 similar to that of FIG. 8 but with a thicker wall.

Figure 12:
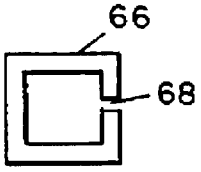
FIG. 12 is a view similar to FIGS. 8 to 10 illustrating a modified sleeve shape.
Figure 13:
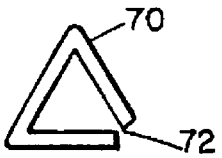
FIG. 13 illustrates a sleeve according to another embodiment.
Figure 14:
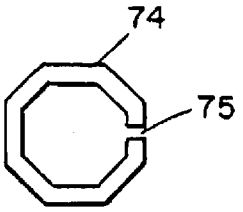
FIG. 14 is a cross-sectional view similar to FIGS. 8 to 13 illustrating yet another modified sleeve.

FIGS. 12 to 14 illustrate some alternative cross-sectional shapes for the elongate tubular sleeve 40 of FIG. 7. In FIG. 12, the elongate tubular sleeve 66 for fitting over a cross bar 50 is of square, rather than circular, cross-section, and has a longitudinal slit 68 extending along one side of the sleeve. In the embodiment of FIG. 13, the sleeve 70 is of triangular cross-section and has a slit 72 at one apex of the triangle. Finally, in FIG. 14, the sleeve 74 is of octagonal cross-section and has a slit 75. In each of these cases, the slit may define a gap as in FIG. 8, or no gap as in FIG. 9, or have overlapping side edges as in FIG. 10. Many other alternative cross-sectional shapes may be used if desired.

Each of the sleeves of FIGS. 8 and 11 to 13 may be provided without any longitudinal slit, for use on racks with hangers having free ends over which the sleeve can be engaged. The sleeve may be closed at one end, as in the embodiments of FIGS. 2 to 6, or may be open ended.

Figure 15:
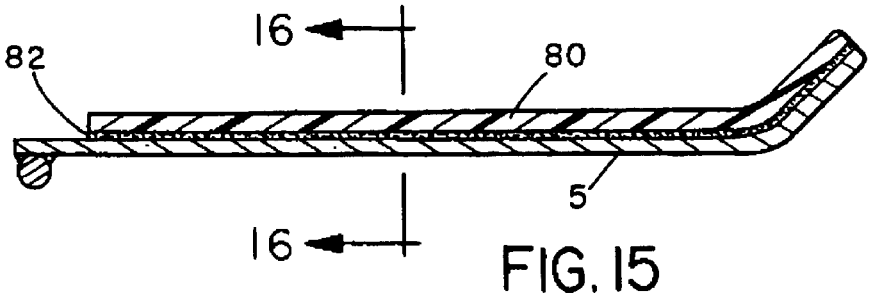
FIG. 15 is a cross-section similar to FIG. 2 illustrating a hanger with an intermediate strip or layer according to another embodiment of the invention.
Figure 16:
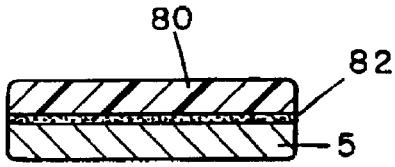
FIG. 16 is a cross-section on the lines 16—16 of FIG. 15.

FIGS. 15 and 16 illustrate another alternative embodiment, in which the intermediate comprises a strip or piece 80 of calendared, pliable conductive silicone adhered to an upper surface of a hanger 5 or cross bar 50 of a rack by a backing layer 82 of conductive adhesive. The strip 80 may be secured over only that region of the hanger or support bar which is engaged by the part, or by a hanger or hook 15 or 52 for the part.

Figure 17:
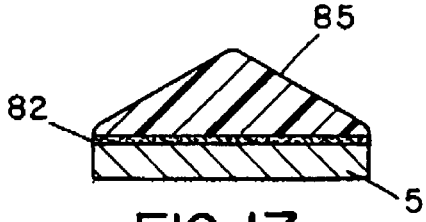
FIG. 17 is a cross-section similar to FIG. 16 illustrating an alternative shape for the strip.
Figure 18:
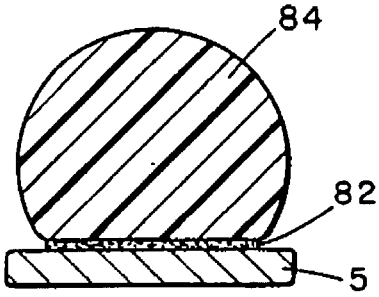
FIG. 18 is a cross-section similar to FIGS. 16 and 17 illustrating another alternative shape.
Figure 19:
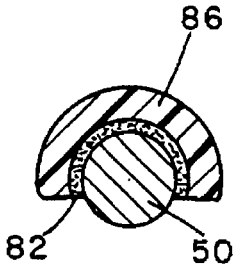
FIG. 19 is a cross-section similar to FIGS. 16 to 18 illustrating an intermediate strip engaged over a cross bar of the hanger rack of FIG. 7.

Strip 80 may be of rectangular cross-section, as indicated in FIG. 16. However, any cross-sectional shape may be used, such as a strip 84 of circular cross-section, as in FIG. 17, or a strip 85 of triangular cross-section, as in FIG. 18, or any other shape. FIG. 19 illustrates a pliable strip 86 adhered over the upper face of the cylindrical cross bar 50 of the rack in FIG. 7, in place of sleeve 40.

Figure 20:
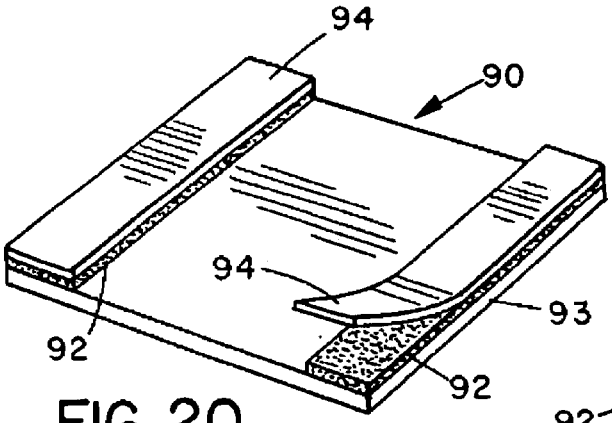
FIG. 20 is a perspective view of the inner face of an alternative version of an intermediate strip for adhering over a hanger member.
Figure 21:
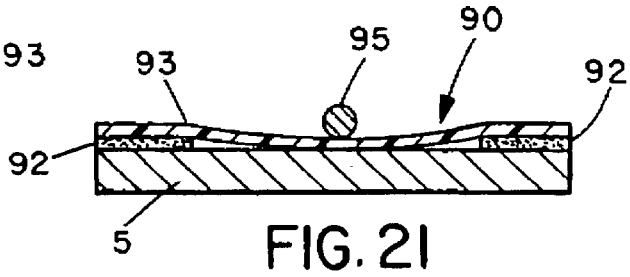
FIG. 21 is a cross-section illustrating the stip of FIG. 20 adhered to a hanger with an article suspended over the strip.
Figure 22:
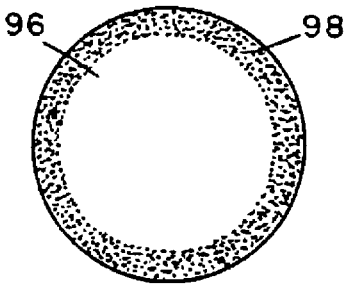
FIG. 22 is a rear plan view of a intermediate strip illustrating an alternative shape for the strip.

FIGS. 20 and 21 illustrate a rectangular or square shape strip 90 of pliable electroconductive material such as conductive silicone in which, instead of a backing layer of conductive adhesive extending over the entire inner face of the strip, stripes 92 of adhesive material are provided along the opposite side edges 93 of the strip, each stripe 92 being covered with a peel-off cover layer 94 of paper or the like to protect the adhesive stripe until the strip is to be applied to a hanger member. The strip 90 may be provided in a continuous length for cutting to a desired size by an end user. As illustrated in FIG. 21, after removing the cover layers 94, the strip 90 may be adhered to a hanger member 5 using the side stripes 92 of adhesive. An article to be coated can then be suspended from the hanger member, with a portion 95 of the article engaging over the center of the strip 90 so as to press the central portion directly against the hanger member, as indicated in FIG. 21. Thus, the conductive silicone strip 90 forms a direct junction between the article 95 and the electroconductive hanger member, with no intervening adhesive. In this case, the adhesive need not be electroconductive.

Figure 23:
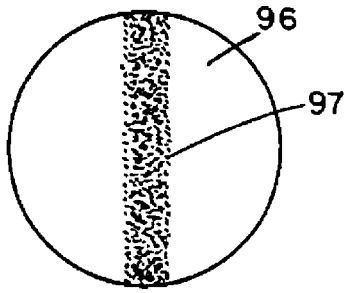
FIG. 23 is a rear plan view of a strip similar to that of FIG. 22 but with a different adhesive arrangement.
Figure 24:
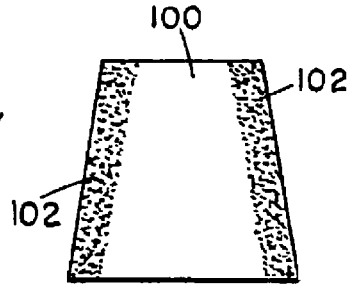
FIG. 24 is a plan view similar to FIGS. 22 and 23 illustrating an alternative shape.

The adhesive-backed pliable electroconductive member may have one or more adhesive coating layers covering all or part of its inner surface, and may be of any desired peripheral shape. Some alternative shapes are illustrated in FIGS. 23 to 26. In FIGS. 23 and 24, an electroconductive member 96 of circular shape is provided. The member 96 has a central stripe 97 of adhesive in FIG. 23, and a peripheral layer 98 of adhesive extends around an annular portion of the periphery of member 96 in FIG. 24. Alternatively, the inner face may be completely coated with an adhesive layer.

Figure 25:
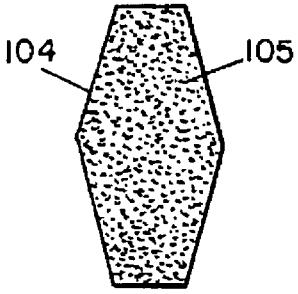
FIG. 25 is a plan view similar to FIGS. 22 to 24 illustrating another alternative shape for the strip.
Figure 26:
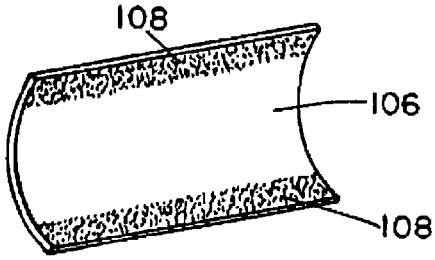
FIG. 26 is a perspective rear view of an alternative arcuate strip.

FIG. 24 illustrates an electroconductive member 100 of alternative, trapezoidal shape with side stripes 102 of adhesive material. In FIG. 25, the electroconductive pliable member is a flat, generally diamond shaped panel 104 coated with an inner layer 105 of adhesive. In each case, the panel or electroconductive member may have an adhesive layer completely or partially coating its inner surface, with the adhesive provided in any desired region or regions. FIG. 26 illustrates an alternative electroconductive strip member 106 which is of rectangular shape but generally arcuate cross-section, for conforming to the outer surface shape of a round bar or rod like hanger. Member 106 is provided with strips 108 of adhesive along its opposite side edges, in a similar manner to the embodiment of FIG. 20, although the adhesive may completely coat the inner surface of member 106 in alternative examples.

In each of the embodiments of FIGS. 15 to 26, the adhesive material may be any suitable electroconductive adhesive, such as a silicone base adhesive available from Kirkhill Rubber of Los Angeles, Calif., or a high temperature acrylic adhesive. The alternatives which have only side strips of adhesive may not require the adhesive to be conductive, which will increase the choice of possible high temperature adhesives for use in these embodiments.

Figure 27:
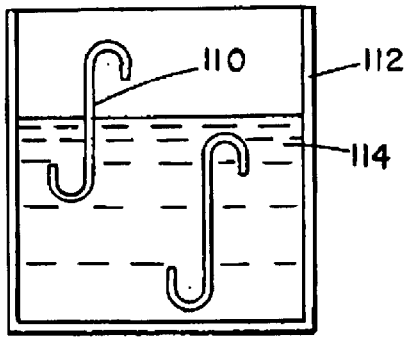
FIG. 27 is a schematic side elevational view illustrating a method for coating part or all of a hanger member with a pliable electroconductive cover layer.
Figure 27A:
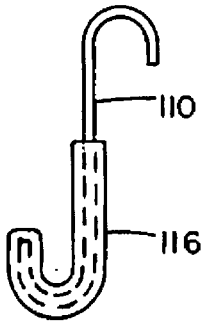
FIG. 27A illustrates the hanger end of a hanger member coated according to the method of FIG. 27.
Figure 27B:
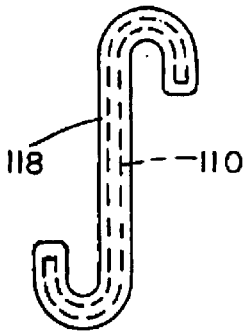
FIG. 27B illustrates a hanger member fully coated according to the method of FIG. 27.

FIG. 27 illustrates an alternative method of providing an electroconductive pliable intermediate at a junction between an electrically conductive, rigid hanger and an article to be coated. In this method, instead of engaging a pre-formed sleeve, tube or adhesive backed strip on the hanger, part or all of a hanger member 110 is dipped into a bath 112 containing a liquid form 114 of the electroconductive, pliable material. The surface of the hanger member which is submerged in the liquid will be coated with the material, and the hanger member is then removed from the bath into a drying station at a suitable temperature for curing the coating layer of electroconductive pliable material. Where the material is electroconductive silicone, the curing temperature will be at or around room temperature. FIG. 27A illustrates one alternative where the hanger member has been partially dipped in bath 112, to form a coating layer 116 of pliable electroconductive material on the hanger end of the member only. FIG. 27B illustrates a second alternative where the entire hanger member 110 is submerged in the bath to form a coating layer 118 extending over its entire length.

Figure 28:
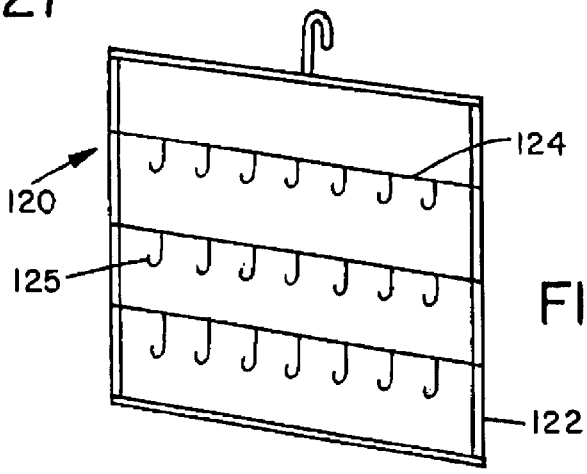
FIG. 28 illustrates an entire hanger rack coated with a pliable electroconductive coating layer according to the method of FIG. 27.

Instead of dipping an individual hanger 110 in bath 112 and subsequently hanging the hanger from a coating rack, an entire rack 120 as illustrated in FIG. 28 may be dipped in the bath 112 so that it is completely covered with a layer of the conductive silicone material 114. Rack 120 comprises a framework of side rails 122 and cross rails 124, with a plurality of spaced hangers 125 secured on each cross rail. After the rack is dipped and coated, and the coating layer is allowed to cure, an intermediate, pliable coating will cover the entire surface of the rack, forming a conductive bridge between any article hung from the rack and the rigid conductive material of the rack. Because the coating layer is soft and pliable, it can be pinched and kneaded in order to remove any powder build up as a result of the electrostatic coating process. It will be understood that the same procedure may be used for coating racks and hangers of any shape or size.

Figure 29:
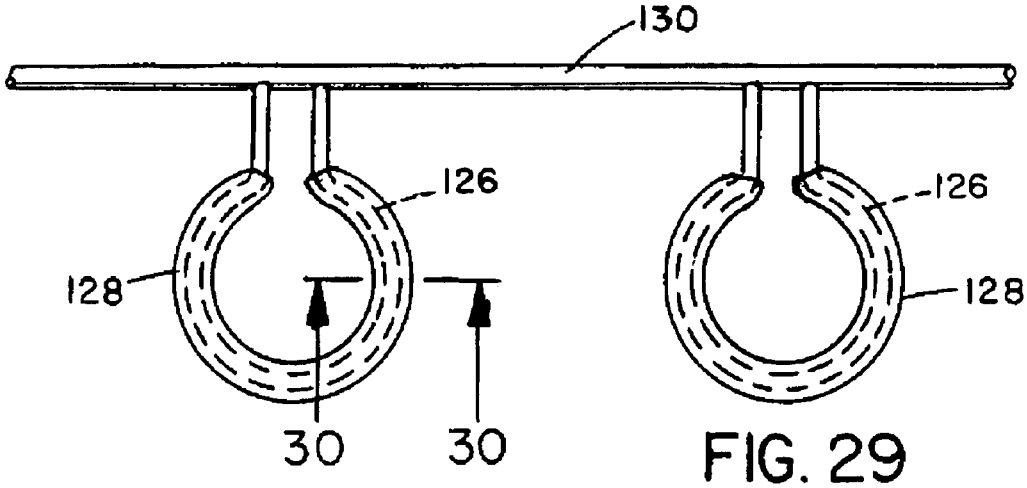
FIG. 29 illustrates another type of hanger member partially coated with an electroconductive cover layer according to the method of FIG. 27.
Figure 30:
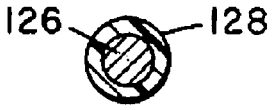
FIG. 30 is a cross-section on the lines 30—30 of FIG. 29.

FIGS. 29 and 30 illustrate an alternative, loop-type hanger 126 which has been coated with an outer layer 128 of a pliable electroconductive material such as conductive silicone. As illustrated in FIG. 29, a series of spaced, loop hangers 126 are welded or otherwise secured to a conductive cross bar 130 of a rack or the like. The hangers 126 may be dipped in a bath 112 of liquid electroconductive material in the manner illustrated in FIG. 27, so that each loop 126 becomes coated with a layer of the material, which is subsequently allowed to cure at room temperature to form an electroconductive, pliable coating layer 128 or intermediate.

Figure 31:
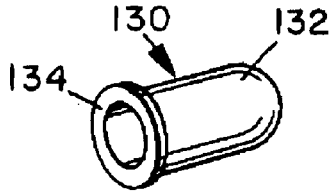
FIG. 31 is a perspective view of an end cap of pliable electroconductive material according to another embodiment of the invention.
Figure 33:
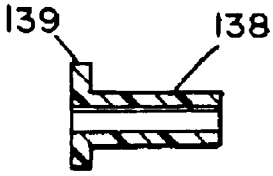
FIG. 33 illustrates a modified, open-ended cap.
Figure 32:
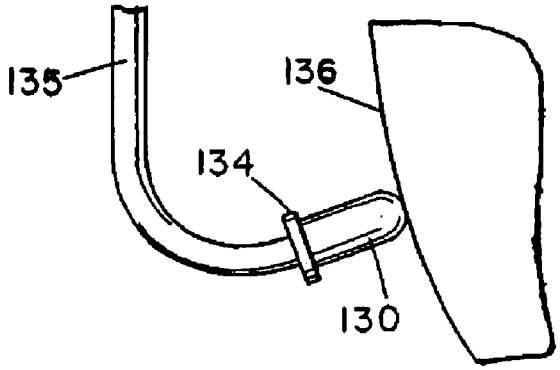

FIGS. 31 and 32 illustrate an electroconductive, pliable cap or sleeve 130 according to another embodiment of the invention. Cap 130 is similar to the embodiment of FIGS. 5 and 6, except that it is of shorter length and of round, rather than rectangular, cross-section. It basically comprises a short tubular portion with one closed end 132 and an annular flange 134 at the opposite end for ease of handling and placement. The cap is formed of an electroconductive pliable material such as conductive silicone. Cap 130 may be placed over the end of a metal conductive hook 135, as indicated in FIG. 32, with a series of such hooks with caps being used to support a large item 136 to be coated, such as a car hood or body. It has been found that, without such a protective cover, the paintwork of the hood or body may be scratched when it is lifted off the hooks, by the metal ends of the hooks. With this arrangement, the pliable caps 130 will protect the paint from such scratches. FIG. 33 illustrates a modified cap 138 which has a through bore open at both ends and an annular flange 139 at one end. The caps 130 and 138 may be made in various different lengths and diameters, depending upon the application.

Figure 34:
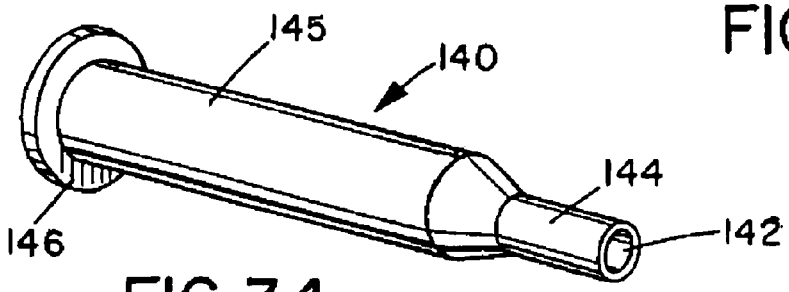
FIG. 34 is a perspective view illustrating a pliable electroconductive intermediate according to another embodiment of the invention.

Finally, FIG. 34 illustrates an alternative electroconductive sleeve or tubular member 140 according to another embodiment of the invention. Unlike the sleeves of FIGS. 2 to 6, sleeve 140 is not of uniform thickness along its length. Instead, the sleeve 140 has a through bore 142 of uniform diameter, but has a stepped outer diameter, with a first end portion 144 of a first diameter and a second end portion 145 of a second, larger diameter, with an annular flange 146 at the end of the larger diameter portion 145. The sleeve may be closed at its smaller diameter end. The sleeve is of a suitable electroconductive pliable material, for example electroconductive silicone. This version may be used in cases where a stepped diameter hanger or support for electrostatic coating is required. Rather than making the metal hanger or rod of stepped diameter, the pliable cover sleeve is stepped, so that a simple, uniform diameter hanger rod may be used, which will be less expensive.

Although exemplary embodiments of the invention have been described above by way of example only, it will be understood by those skilled in the field that other embodiments are also possible and that significant modifications may be made to the disclosed embodiments without departing from the scope of the invention.

I claim:

1. A method of electrostatic coating, comprising the steps of:

engaging a pliable, electro conductive intermediate cap having a bore extending over substantially the entire length of the cap directly over a substantially rigid electrically conductive hanger, at least a portion of the hanger and the intermediate cap being disposed in a generally horizontal orientation, and the intermediate cap forming a cover layer of substantially uniform thickness over the hanger;

hanging an article to be coated over the hanger so that the article is suspended from the hanger and the intermediate cap forms a protective cover layer disposed between the hanger and article and in direct contact with both the hanger and the article;

carrying out an electrostatic coating process on the article; and repeating the steps with other articles to be treated after recycling or replacing the intermediate cap to remove any unwanted deposits of the coating process accumulated on the intermediate cap.

2. The method as claimed in claim 1, wherein said intermediate cap is formed of a material selected from the group consisting of rubber, plastic, and metallic foil.

3. The method as claimed in claim 2, wherein said material comprises conductive silicone.

4. The method of any of claims 1 to 3 wherein said intermediate cap has a resistivity of less than about 1 megohm.

5. The method of claim 1, wherein said intermediate cap is capable of withstanding heat of between 200° F. and 600° F.

6. The method of claim 1, wherein said cap has an open end and a closed end, and said engaging step comprises slidably engaging the open end of said cap over a free end of said hanger and sliding the cap bore over at least part of the hanger until the closed end of said cap engages the end of said hanger.

7. A method of electrostatic coating, comprising the steps of:

taking a pliable, electro conductive intermediate member having a bore extending over substantially the entire length of the member and at least one open end;

engaging the intermediate member directly over a substantially rigid electrically conductive hanger, at least a portion of the hanger and the intermediate member being disposed in a generally horizontal orientation, and the intermediate member forming a cover layer of substantially uniform thickness over the hanger;

hanging an article to be treated over the intermediate member so that the article is suspended from the hanger and the intermediate member forms a protective cover layer disposed between the hanger and article and in direct contact with both the hanger and the article;

carrying out an electrostatic coating process on the article; and repeating the steps with other articles to be treated after recycling or replacing the intermediate member to remove any unwanted deposits of the coating process accumulated on the intermediate member.

8. The method as claimed in claim 7 wherein the intermediate member comprises a cap having one closed end and the step of engaging the cap over the hanger comprises slidably engaging the bore of the cap over the hanger until the closed end of the cap reaches a free end of the hanger.

9. The method as claimed in claim 7, wherein said intermediate member is of conductive silicone material.

10. An electrostatic coating method, comprising the steps of:

taking a pliable, electro conductive intermediate member having a bore extending over at least substantially the entire length of the member and at least one open end;

engaging the intermediate member directly over a substantially rigid electrically conductive hanger, at least a portion of the hanger and the intermediate member being disposed in a generally horizontal orientation, and the intermediate member forming a cover layer of pliable electro conductive material and substantially uniform thickness directly over the hanger;

hanging an article to be coated directly over the electro conductive intermediate member so that the article contacts only the electro conductive intermediate member and is suspended from the hanger, whereby the intermediate member forms a protective cover layer disposed between the hanger and article and in direct contact with both the article and hanger;

carrying out an electrostatic coating process on the article; and repeating the steps with other articles to be treated after recycling or replacing the intermediate member at periodic intervals to remove any unwanted deposits of the coating process accumulated on the intermediate member.

* * * * *